US006715751B2

(12) United States Patent
Henn

(10) Patent No.: US 6,715,751 B2
(45) Date of Patent: Apr. 6, 2004

(54) DEVICE FOR ADJUSTING THE POSITION OF SHEET MATERIAL WHEN A DIRECTION OF MOTION THEREOF IS REVERSED

(75) Inventor: Andreas Henn, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 141 days.

(21) Appl. No.: 09/997,975

(22) Filed: Nov. 29, 2001

(65) Prior Publication Data

US 2002/0063381 A1 May 30, 2002

(30) Foreign Application Priority Data

Nov. 29, 2000 (DE) ..... 100 59 274

(51) Int. Cl.[7] ..... B41F 83/14

(52) U.S. Cl. ..... 271/82; 271/204; 271/206; 101/410

(58) Field of Search ..... 271/204, 205, 271/206, 82; 101/137, 142, 177, 217, 408, 409, 410

(56) References Cited

U.S. PATENT DOCUMENTS

| | | | | | |
|---|---|---|---|---|---|
| 2,950,915 | A | * | 8/1960 | Golding | 271/241 |
| 4,735,142 | A | * | 4/1988 | Haupenthal | 101/246 |
| 5,125,334 | A | * | 6/1992 | Marx et al. | 101/183 |
| 5,333,547 | A | * | 8/1994 | Pfisterer et al. | 101/409 |
| 5,335,597 | A | * | 8/1994 | Helmstadter | 101/485 |
| 5,406,884 | A | * | 4/1995 | Okuda et al. | 101/137 |
| 5,539,864 | A | * | 7/1996 | Hauck et al. | 358/1.5 |
| 5,659,178 | A | * | 8/1997 | Bucher et al. | 250/559.3 |
| 6,349,641 | B1 | * | 2/2002 | Bayer et al. | 101/142 |
| 6,357,741 | B1 | * | 3/2002 | Cassoni | 271/206 |
| 6,419,187 | B1 | * | 7/2002 | Buter et al. | 244/35 R |

FOREIGN PATENT DOCUMENTS

| | | | | |
|---|---|---|---|---|
| DE | 34 00 652 A1 | | 7/1985 | |
| DE | 3400652 A1 | * | 7/1985 | B41F/21/04 |
| DE | 85 03 577.7 | | 7/1987 | |
| DE | 41 13 478 A1 | | 10/1992 | |
| DE | 42 29 645 A1 | | 3/1994 | |
| DE | 44 06 740 A1 | | 9/1995 | |
| DE | 4406740 A1 | * | 9/1995 | B41F/33/14 |
| DE | 44 21 199 A1 | | 12/1995 | |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A method of correcting a position of sheet material on conveying elements, the sheet material extending from a surface of a first sheet-conveying element to a surface of a second sheet-conveying element following downline from the first sheet-conveying element, as viewed in a conveying direction of the sheet material, which comprises detecting an actual position of a leading edge of the sheet material by at least one sensor element disposed on the first sheet-conveying element; by a control unit, making a comparison between a nominal and the actual position of the sheet material; and, if the actual position deviates from the nominal position of the sheet material, causing an actuator to fix the sheet material to the following second sheet-conveying element so as to perform a correction of the position deviation; a reversing or turning device in combination with the correction device; a printing unit having the correction device; and a multicolor printing machine in combination with the correction device.

16 Claims, 2 Drawing Sheets

DEVICE FOR ADJUSTING THE POSITION OF SHEET MATERIAL WHEN A DIRECTION OF MOTION THEREOF IS REVERSED

BACKGROUND OF THE INVENTION

Field of the Invention

The invention relates to a device for adjusting the position of sheet material when a direction of motion thereof is reversed, for example when sheet material is turned or reversed between printing units in multi-color rotary printing machines.

The published German Patent Document DE 41 13 478 A1 is concerned with an electronic sheet inspection device for cylinders in sheet-fed rotary printing machines. Sensing elements including linear CCDs and a light source register the leading edge of the respective sheet-material and the correct position thereof for a register-maintaining sheet transfer. By this inspection device, curved regions of a sheet-material leading edge are detected, in order specifically to correct possible faults by changing printing parameters. This paper position inspection makes it possible to register the sheet leading edge in the gripper system of each printing unit in a printing machine, in order even to detect printed sheet positional changes in the gripper system during the sheet transfer from one cylinder to another cylinder. The determined measured values are fed out of the cylinder to an evaluation device and are held ready in a data storage device for interrogation when the cylinder is at a standstill.

The published German Patent Document DE 85 03 577 U1 describes a register rail or bar having rotatably motor-driven setting screws, for stopping the leading edge of a respective sheet. By the rotatably motor-driven setting screws, the register rail or bar can be given a slight curvature, in order to bow the sheet slightly during the sheet acceleration in order to improve the contact thereof with the outer cylindrical or jacket surface of a cylinder.

The published German Patent Document DE 44 06 740 A1 discloses a device for color register correction in a rotary printing machine. In this correction device, a sheet holder grips the sheet at an edge region thereof leading in the conveying direction, electronic measuring elements being provided for establishing the sheet position. Sheet holders are displaceably arranged and are connected to motorized actuating elements controlled by the measuring elements. According to this embodiment, the sheet holders are constructed so as to be movable in the conveying direction and transversely to the conveying direction of the sheet. Signals from a nominal/actual comparison of the measuring elements determining the sheet position control the associated actuating elements which influence the sheet position at a contact surface.

It has become known heretofore that the color register of sheet material to be reversed or turned is always determined by the position of the leading edge of the sheet material. The trailing edge of the sheet material cannot be used as a reference edge, because of cut tolerances on the printing materials, which occur during the production thereof. A precondition for a good color register, i.e., one which maintains tolerance, is the maintenance of tolerance of the transfer color register. This means that the leading edge of each individual copy of the sheet material is positioned within the transfer color register tolerance range in the gripper system of a storage drum or a machine component, for example, which is the last to carry the printing material at the leading edge thereof before the printing material is picked up at the trailing edge thereof. In order to achieve this, the sheet is tautened in various ways at the trailing edge on the outer cylindrical or jacket surface of a sheet-carrying cylinder. For this purpose, use is made, for example, of sucker systems, which are capable of performing a relative movement with respect to the circumferential direction of the respective sheet-carrying cylinder, and exert a pulling force on the copy of the sheet material. The respective gripped copy is completely smoothened thereby, i.e., tautened, before the printing material is transferred to a gripper system for fixing the printing-material trailing edge.

The quality of the tautening of the sheet material on the outer jacket surface of the sheet-carrying cylinder, respectively, carrying the sheet material controls the manner in which the perfecting register, i.e., the systematic deviation of each piece of sheet material from the nominal or desired position, results in each case, taking into account tautening faults which are always the same from sheet to sheet, and/or the perfecting register, i.e., a stochastic deviation from the nominal position, for example, of tautening faults which repeatedly occur irregularly from sheet to sheet. These printing quality criteria are always determined in the same way by the relative position of the tautening elements, for example, tautening elements which are displaceable from the circumferential direction thereof on the outer jacket surface, to the gripper system for fixing the trailing edge of the fixed sheet material. In this regard, the perfecting register is determined by the accuracy; the color register is determined by the precision of repetition. Both operations, and particularly the tautening operation, cannot be performed with the demanded precision at higher printing speeds and in the case of certain printing materials, so that this circumstance has to be taken into account when turning or reversing sheet material between printing units of rotary printing machines.

SUMMARY OF THE INVENTION

In view of the afore-discussed prior art and the aforementioned technical problem, it is an object of the invention to provide a device for adjusting the position of sheet material when a direction of motion thereof is reversed, wherein turned or reversed sheet material is optimally adjusted in the position thereof even during the turning or reversing operation.

With the foregoing and other objects in view, there is provided, in accordance with a first aspect of the invention, a method of correcting a position of sheet material on conveying elements, the sheet material extending from a surface of a first sheet-conveying element to a surface of a second sheet-conveying element following downline from the first sheet-conveying element, as viewed in a conveying direction of the sheet material, which comprises detecting an actual position of a leading edge of the sheet material by at least one sensor element disposed on the first sheet-conveying element; by a control unit, making a comparison between a nominal and the actual position of the sheet material; and, if the actual position deviates from the nominal position of the sheet material, causing an actuator to fix the sheet material to the following second sheet-conveying element so as to perform a correction of the position deviation.

In accordance with another mode, the method of the invention includes providing jacket surfaces of sheet-guiding cylinders as the conveying elements, the sheet material extending from the jacket surface of a first sheet-guiding cylinder to a jacket surface of a second sheet-guiding cylinder, as viewed in the travel direction of the sheet material.

In accordance with a further mode, the method of the invention includes registering, by the sensor element, a time offset between a start of the movement of an actuator-operated gripper system and a start of movement of the edge of the sheet material covering the sensor element.

In accordance with an added mode, the method of the invention includes measuring the time offset in degrees of machine angle.

In accordance with an additional mode, the method of the invention includes determining the time offset of the start of movement by a sensor element constructed as an edge sensor.

In accordance with yet another mode, the method of the invention includes determining the time offset of the start of movement by a sensor element constructed as a linear CCD.

In accordance with yet a further mode, the method of the invention includes performing the correction of the position of the sheet material based upon the laws of motion of an actuator-operated gripper system provided on the following second sheet-guiding cylinder, whereon the trailing edge of the sheet material is gripped.

In accordance with yet an added mode, the method of the invention includes coming to a conclusion, if a time offset set in the control unit is exceeded, that the trailing edge of the sheet material has not been gripped by an actuator-operated gripper system.

In accordance with another aspect of the invention, there is provided a device for correcting a position of a sheet material when a direction of motion of the sheet material is reversed in a reversing device, comprising a holding device of a sheet-guiding cylinder serving as a storage drum, a sensor element for sensing a leading edge of the sheet material, the sensor element being assigned to the holding device, another holding device for a trailing edge of the sheet material disposed on a sheet-guiding cylinder serving as a turning drum, and an operatable actuator assigned to the other holding device of the sheet-guiding cylinder serving as the reversing drum for position correction of the other holding device.

In accordance with a first alternative embodiment of the invention, the operatable actuator is constructed as a linear drive.

In accordance with a second alternative embodiment of the invention, the operatable actuator is constructed as a piezoelectric actuator.

In accordance with a third alternative embodiment of the invention, the operatable actuator is constructed as a magnetic bearing.

In accordance with a further feature of the invention, the sensor element and the other holding device of the sheet-guiding cylinder serving as a reversing drum are connected to one another via a control unit with data and control lines, and the control unit has a control device and a characteristic-curve family map wherein parameters relating to the sheet material to be processed are stored.

In accordance with an added aspect of the invention, there is provided a reversing device for sheet material in sheet-processing machines, in combination with a device for correcting a position of sheet material when a direction of motion thereof is reversed, comprising a holding device of a sheet-guiding cylinder serving as a storage drum, a sensor element for sensing a leading edge of the sheet material, the sensor element being assigned to the holding device, another holding device for a trailing edge of the sheet material disposed on a sheet-guiding cylinder serving as a reversing drum, and an operatable actuator assigned to the other holding device of the sheet-guiding cylinder serving as the reversing drum for position correction of the other holding device.

In accordance with an additional aspect of the invention, there is provided a printing unit having a device for correcting a position of sheet material in a reversing device, comprising a holding device of a sheet-guiding cylinder serving as a storage drum, a sensor element for sensing a leading edge of the sheet material, the sensor element being assigned to the holding device, another holding device for a trailing edge of the sheet material disposed on a sheet-guiding cylinder serving as a reversing drum, and an operatable actuator assigned to the other holding device of the sheet-guiding cylinder serving as the reversing drum for position correction of the other holding device.

In accordance with a concomitant aspect of the invention, there is provided a multicolor printing machine for processing sheet material, in combination with a device for correcting a position of a sheet material in a reversing device, comprising a holding device of a sheet-guiding cylinder serving as a storage drum, a sensor element for sensing a leading edge of the sheet material, the sensor element being assigned to the holding device, another holding device for a trailing edge of the sheet material disposed on a sheet-guiding cylinder serving as a reversing drum, and an operatable actuator assigned to the other holding device of the sheet-guiding cylinder serving as the reversing drum for position correction of the other holding device.

The advantages which can be achieved with the invention can primarily be seen in that the determination of the time offset, which can be measured in machine degrees and therefore independently of the speed, can be used to determine the start of the relative movement between the sheet leading edge and the gripper system in relation to the relative movement expected at the sheet trailing edge in accordance with the laws of motion. Therefore, a measure is available for the necessary reversing color register correction on the surface of the sheet-guiding cylinder following a first sheet-guiding cylinder configured, for example, as a storage cylinder. Determining the time offset in machine degrees permits a determination which is independent of the printing speed of the rotary printing machine. On the way to the next printing unit of a sheet-processing multicolor rotary printing machine having a plurality of printing units, a position correction determined in this way can be controlled or regulated out appropriately on one of the sheet-carrying components by an actuator. This means that, for example on the outer surface of a storage drum, a correction can be made to the position of the sheet.

In an advantageous refinement of the concept upon which the invention is based, a time offset between the start of the movement of an actuator-operated gripper system and the start of movement of the edge of the sheet material that covers the sensor element can be registered by the sensor element on an outer cylindrical or jacket surface of a first sheet-guiding cylinder. From the determination of this time offset, a position correction can be achieved in the form of a position correction, performed by a control unit, of the actuator-operated gripper system on the circumference of the cylinder functioning as a storage drum and arranged downline from the first cylinder guiding the sheet material, as viewed in the travel direction of the sheet.

In order to register the time offset independently of the printing speed of the rotary printing machine, the offset is measured in degrees of machine angle. A measurement in degrees of machine angle can be performed particularly simply and with high reliability.

The measurement of the time offset of the start of movement may be performed by a sensor element constructed as an edge sensor. In addition to constructing the sensor element arranged on the jacket surface of the first sheet-carrying cylinder as an edge sensor, it may also be constructed as a linear CCD sensor.

It is equally possible to use sensors which detect light that shines through, from which the presence or the absence of a sheet material in the position thereof on the first sheet-guiding cylinder can be detected.

In order to determine the position correction of the sheet material during the turning operation from the front thereof to the back thereof, which then represents the new front to be printed subsequently, a calculation is performed based upon the laws of motion of the actuator-operated gripper system on the first following sheet-guiding cylinder, functioning as a storage drum, on which the trailing edge of the reversed sheet material is gripped. If a time offset preset in the control unit is exceeded, it is possible to conclude that the trailing edge of the sheet material has not been gripped by the actuator-operated gripper system on the sheet-guiding cylinder which follows the first sheet-guiding cylinder and which serves as a storage drum in a reversing device. Therefore, by determining the time offset, proposed in accordance with the invention, from the start of movement of the sheet leading and sheet trailing edge, it is also possible to make deductions about the presence or the absence of a copy of the sheet material on the jacket surface of sheet-guiding cylinders. This criterion for the detection of missing sheets can be implemented in addition to already known missing-sheet criteria and, in combination with the criterion, can help to reduce the probability of error or can be used as the sole sensor system for monitoring missing sheets.

By the proposed solution according to the invention, a position correction may therefore be made with high precision and high reliability, because the tautening of the sheet material to be turned or reversed can be influenced directly, even during the reversing or turning operation, by the sensor element and the actuator-operated gripper system that grips the new sheet leading edge, i.e., the old sheet trailing edge of the sheet material. By arranging the sensor system that detects the position of one sheet edge on the first sheet-guiding cylinder, and also the provision of the actuator-operated gripper system on the following or succeeding cylinder guiding the sheet material, the element that picks up the new sheet leading edge can be used to correct the position of the sheet material on the circumference of the sheet-guiding cylinder serving, for example, as a storage drum. On the way to the next printing unit, the position correction thus determined may be controlled out appropriately, on one of the sheet-carrying components, by an actuator with which the actuator-operated gripper system is moved.

In an advantageous refinement of the concept upon which the invention is based, the actuator of the actuator-operated gripper system may be constructed as a linear drive. In addition to the construction of the actuator element as a linear drive, the actuator can also be constructed as a piezoelectric actuator; furthermore, the operatable actuator of the gripper system on the following sheet-guiding cylinder serving as a storage drum can be constructed as a magnetic bearing. The sensor element on the first sheet-guiding cylinder and the actuator-operated holding device of the sheet-guiding cylinder arranged downline from the latter and serving as a turning drum are connected to one other via a control unit and via data and control lines, the control unit having both a storage device and a characteristic-curve family, wherein parameters, respectively, relating to the sheet material to be processed are stored. Such parameters can be, for example, the grammage, the format, the quality of the cut edge, the tolerances of these dimensions, and so forth.

A device having the foregoing features may preferably be used on a reversing or turning device belonging to rotary printing machines for processing sheet material. The reversing or turning device is preferably used in multicolor rotary printing machines and is arranged approximately in the middle of the multicolor rotation, for example, after the second printing unit in the case of four printing units with a finishing unit, and after the third printing unit in the case of six printing units with a finishing unit; however, different embodiments are also conceivable wherein the reversing or turning unit is even arranged after the second printing unit. Reversing or turning devices for sheet material are preferably used in multicolor rotary printing machines.

Other features which are considered as characteristic for the invention are set forth in the appended claims.

Although the invention is illustrated and described herein as embodied in a device for adjusting the position of sheet material when the direction of motion thereof is reversed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
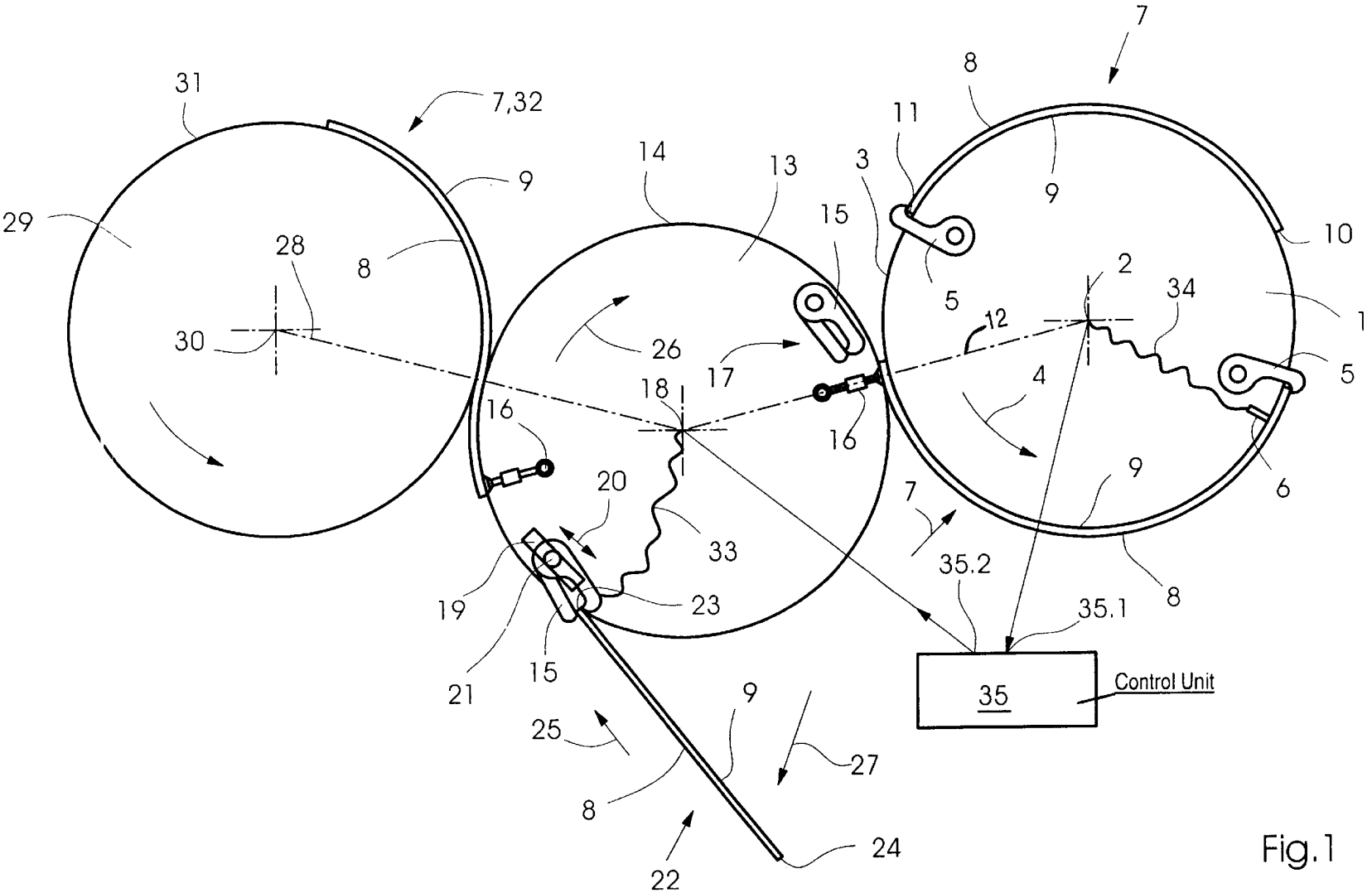
FIG. 1 is a diagrammatic side elevational view of a configuration of cylinders for turning or reversing sheet material, a sensor element and an actuator-operated holding device being provided in respective jacket or outer surfaces of the cylinders.

Referring now to the drawings and, first, particularly to FIG. 1 thereof, there is shown therein a configuration of cylinders of a printing unit for rotary printing machines, with which sheet material can be turned or reversed from a front side thereof to a rear side thereof.

On an outer cylindrical or jacket surface 3 of a first sheet-guiding cylinder 1, which serves as a storage drum, for example, a copy 7 of a sheet material is picked up. The copy 7 held on the jacket surface 3 by a holding device 5 has an upper side 8 facing outwardly, while the copy 7 rests by the underside 9 thereof on the jacket surface 3 of the first sheet-guiding cylinder 1. An edge 11 of the sheet material shown in FIG. 1 is the leading edge in this conveying condition of the copy 7, and a trailing edge of the sheet material is identified by reference numeral 10 in FIG. 1. The first sheet-guiding cylinder 1 rotates about a rotational axis 2 in counterclockwise direction, as represented in FIG. 1 by an arrow 4. The copy 7 held at the leading edge 11 thereof is conveyed on the jacket or outer cylindrical surface 3 in the direction of rotation of the arrow 4, passing a transfer center line 12, due to the rotation of the cylinder 1 about the rotational axis 2 thereof, into the position thereof illustrated on the lower half of the jacket surface 3 of the first sheet-guiding cylinder 1 shown in FIG. 1. The leading edge 11 of the copy 7 is also gripped by the holding device 5, the position of the leading edge of the copy 7 of the sheet material relative to the outer cylindrical or jacket surface 3 being registered by a sensor element 6. The sensor element 6 is connected via a signal line 34 to an input side 35.1 of a control unit 35, reproduced highly diagrammatically here.

In the condition illustrated in FIG. 1, on the transfer center line 12 extending through the rotational axis 2 of the first sheet-guiding cylinder 1 and also through a rotational axis 18 of a sheet-guiding cylinder 13 arranged downline from the first cylinder 1 and functioning as a turning or reversing drum, the sheet trailing edge 10 of the copy 7 is transferred to a holding device 16 which is accommodated on the outer cylindrical or jacket surface 14 of the sheet-guiding cylinder 13 following or upline from the cylinder 1, which, for example, can be constructed as a rotatable sucker. In the vicinity of the transfer center line 12 between the outer cylindrical or jacket surface 3 of the first sheet-guiding cylinder 1 and the outer cylindrical or jacket surface 14 of the sheet-guiding cylinder 13 following or upline from the cylinder 1, the holding device 16 constructed as a sucking element picks up the trailing edge 10 of the copy 7. In this condition, the copy 7 of the sheet material is fixed at the leading edge 11 thereof on the outer cylindrical or jacket surface 3 of the first sheet-guiding cylinder 1 by the holding device 5, while the trailing edge 10 of the copy 7 is already held by the holding device 16 in the succeeding or downline sheet-guiding cylinder 13. The holding device 16, constructed as a sucking element in the embodiment according to FIG. 1, has a pivotable holding element 15 in the shape of a tongs-type gripper assigned thereto, this gripper 15 picking up the trailing edge 10 of the copy 7, which then represents a leading edge 23 of a turned copy 32 of the sheet material. The sheet material is released by the holding device 5 of the first sheet-carrying cylinder 1. The releasing movement of the edge of the copy 7 of the sheet material, which covers the sensor element 6, is transmitted to the input side of the control unit 35.1 by the signal or data line 34.

During the rotation of the succeeding sheet-guiding cylinder 13, serving as a reversing or turning drum, in the clockwise direction represented by the arrow 26 about the rotational axis 18 of the cylinder 13, the holding device 15 constructed as a tongs-type gripper rotates through at least approximately 180° about a pivot axis 21 thereof, so that the sheet material, with the trailing edge 24 (the former leading edge 11) thereof, completes an outward pivoting movement represented by the arrow 27 relative to the outer cylindrical or jacket surface 14 of the succeeding sheet-guiding cylinder 13 serving as a storage drum. The copy 7 then completes a reversal of conveying direction in the direction of the arrow 25; the underside 9 of the sheet material 7 faces towards the jacket surface 14 of the sheet-guiding cylinder 13 serving as a storage drum, and the upper side 8 of the sheet material faces outwardly from the succeeding cylinder 13. During the rotation of the succeeding cylinder 13, serving as a turning or reversing drum, in the clockwise direction represented by the arrow 26 about the rotational axis 18, the position of the sheet leading edge 23 is corrected. The position correction is performed by the gripper system gripping the leading edge 23 of the copy 7, i.e., the tongs-type gripper 15, being moved by an actuator 19 in directions of movement represented by the double-headed 20 relative to the jacket surface 14 of the succeeding sheet-carrying cylinder 13. The actuator 19, which controls the position of the tongs-type gripper 15 in relation to the jacket surface 14, is driven via the drive line 33 via the output side 35.2 of a control unit 35, which is shown only diagrammatically in FIG. 1.

At a transfer center line 28, which extends through the rotational axis 18 of the succeeding sheet-guiding cylinder 13 serving as a reversing or turning drum, and also through a rotational axis 30 of a third sheet-carrying cylinder 29, the sheet material 7 is transferred to the outer cylindrical or jacket surface 31 of this third sheet-guiding cylinder 29. During the transfer performed at the transfer center line 28 from the jacket surface 14 to the jacket surface 31, the previous upper side 8 of the sheet material then faces towards the jacket surface 31 of the third sheet-guiding cylinder, while the previous underside 9 faces outwardly. It is thereby then possible to print the underside 9 of the sheet material 7 in the turned or reversed condition 32 thereof.

The sensor element 6, which can be constructed, for example, as an edge sensor element, as a linear CCD or as a transmitted-light sensor, is connected via the data line 34 to the input side 35.1 of the control unit 35. The control unit 35, in turn, acts via a data line 33 on the actuator 19, which activates a position correction of the tongs-type gripper 15 which picks up the sheet edge 23, the position correction being performed in the circumferential direction represented by the double-headed arrow 20. Correcting the position of the copy 7 of the sheet material is effected by using the measurement of the time offset, which is preferably measured in machine degrees, at the switching output of an edge sensor element 6, for example, as a relative movement between the sheet leading edge 11 of the copy 7 and the expected relative movement of the trailing edge 10 (the new leading edge 23), which is gripped by the tongs-type gripper 15. A time offset determined by the control unit 35, i.e, a copy of the sheet material not resting optimally on the jacket surfaces 3 and 14, respectively, can be compensated for by a position correction by moving the actuator-operated gripper element 19 in the direction of movement represented by the double-headed arrow 20 on the jacket surface 14 of the sheet-carrying cylinder 13 serving as a reversing or turning drum. The extent of the time offset is a measure of the travel in the direction 20 by the holding element 15 to be produced by the actuator 19 in relation to the jacket surface 14 of the succeeding sheet-carrying cylinder 13 functioning as a reversing or turning drum.

The color register can be controlled, during the turning or reversing operation, by the sensor element 6 disposed on the circumferential surface 3 of the first sheet-guiding cylinder 1, regardless of the type of sensor element that is being used. From the measurement of the time offset, the start of the relative movement of the sheet leading edge and the sheet trailing edge, using the laws of motion of the holding system 15 gripping the new sheet leading edge 23 and constructed as a tongs-type gripper, it is possible for a position correction for the actuator-operated gripper system 15 to be determined. The correction of the circumferential position of the actuator-operated holding system 15 with respect to the jacket surface 14 of the succeeding sheet-guiding cylinder 13 serving as a turning or reversing drum can be performed on the way to the next printing unit by driving the actuator 19 close to the output 35.2 of the control unit 35.

The signal from the sensor element 6 which is covered by the sheet material cannot be used to control the color register, but is suitable for detecting so-called missing sheets. By the so-called missing sheets, there is meant those copies 7 which have not been gripped at the trailing edge 10 (the new sheet leading edge 23 at the tongs-type gripper 15) and, therefore, cannot be conveyed further through the printing machine.

Starting from a specific machine degree value, if the copy 7 or the leading edge 11 thereof is not detected by the sensor element 6, the gripper system, constructed as a tongs-type gripper 15, on the succeeding sheet-carrying cylinder 13, i.e., the turning or reversing drum, cannot have gripped the copy 7 of sheet material. It is possible, in turn, to conclude therefrom, that a missing sheet has been detected, which can be used, on its own or in combination with other systems, for the detection of the presence or absence of the sheet material along the conveying path thereof.

Figure 2:
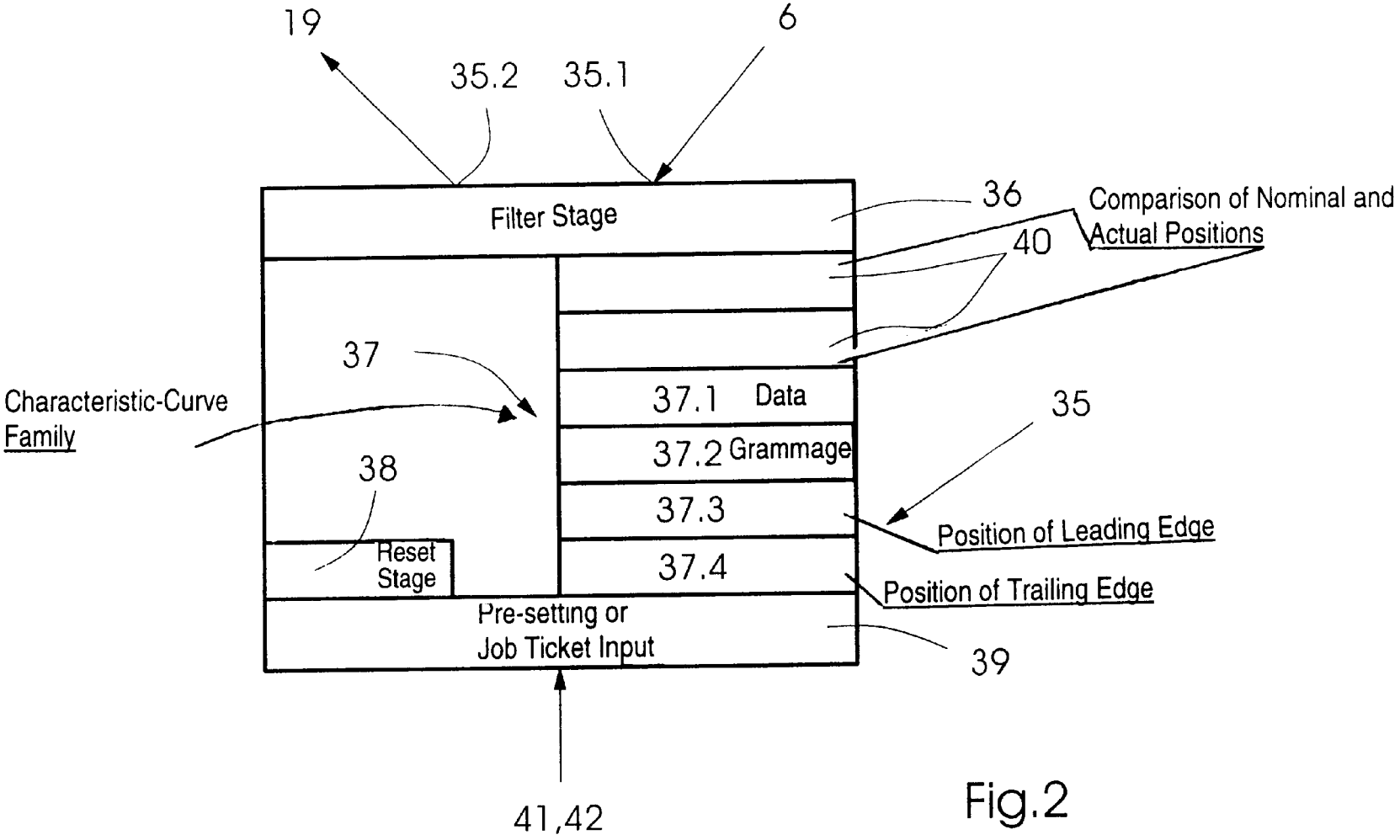
FIG. 2 is a block diagram of a control device of FIG. 1 for driving an actuator for the holding device in accordance with signals detected by the sensor element.

FIG. 2 shows in greater detail a diagrammatic reproduction of the control device 35 which drives the actuator 19 in accordance with signals detected by the sensor element 6.

From the sensor element 6, the signals thereof are passed to the input side 35.1 of the control unit 35. From the sensor element 6, the signals thereof are thus transmitted via a data transmission line 34 to the input 35.1 of the control unit 35. On the output side, i.e., on the output port 35.2 of the control unit 35, the drive signals are transmitted to the actuator 19 of the holding device 15 via the drive line 33.

Due to the drive signals, a movement of the holding device 15 in the circumferential direction corresponding to the double-headed arrow 20 can be performed relative to the outer cylindrical or jacket surface 14 of the next-following or succeeding sheet-guiding cylinder 13.

The control unit 35 is diagrammatically shown configured so that input variables 41 and 42, which correspond to a predefinition of the format or presetting data for a respective print job, can be input into the control unit 35. This print job includes a turning or reversing action wherein the sheet material is turned or reversed from a front side thereof to a rear side thereof which is likewise to be printed. The data about the printing material which is used can be stored in a control unit 35 in a family 37 of characteristic curves. For example, in the characteristic-curve family 37 in the control unit 35, there are data 37.1 relating to the format of the sheet material to be printed. Also stored in the characteristic-curve family 37, in a memory 37.2, is the grammage of the sheet material, which is needed to determine the flexural rigidity thereof. In addition, at designated memory locations 37.3 and 37.4, information is provided relating to the position of the leading and trailing edges, respectively, of the sheet material. In a memory 39, data that is relevant within the context of pre-setting or relating to the input of the job ticket are stored in the control unit 35 associated with the turning or reversing device. The control unit 35 also includes a reset stage 38, with which a zero setting of the system can be attained; in addition, input and output signals are subjected to filtering in a filter stage 36 before further processing. A comparison between a required nominal position relative to a detected actual position of the sheet material on the outer cylindrical or jacket surface 3 of the first sheet-carrying cylinder 1 serving as a storage drum and the actual position of the sheet material is performed in a comparison stage 40 which, in the view according to FIG. 2, is formed in two stages. The actuator 19, which can be driven via the drive line 33, can be constructed both as a piezoelectric actuator, as a linear drive and as a magnetic bearing, with which the tongs-type gripper 15 may be displaced in the circumferential direction on the jacket surface 14 of the succeeding cylinder 13 serving as a turning or inverting drum. The sensor element 6, which acts upon the input side 35.1 of the control unit 35, can be configured as an edge sensor, a linear CCD or a transmitted-light sensor.

I claim:

1. A method of correcting a position of sheet material on conveying elements, the sheet material extending from a surface of a first sheet-conveying element to a surface of a second sheet-conveying element following downline from the first sheet-conveying element, as viewed in a conveying direction of the sheet material, which comprises detecting an actual position of a leading edge of the sheet material by at least one sensor element disposed on the first sheet-conveying element; by a control unit, making a comparison between a nominal and the actual position of the sheet material; and, if the actual position deviates from the nominal position of the sheet material, causing an actuator to fix the sheet material to the following second sheet-conveying element so as to perform a correction of the position deviation.

2. The method according to claim 1, which includes providing jacket surfaces of sheet-guiding cylinders as the conveying elements, the sheet material extending from the jacket surface of a first sheet-guiding cylinder to a jacket surface of a second sheet-guiding cylinder, as viewed in the travel direction of the sheet material.

3. The method according to claim 1, which includes registering, by the sensor element, a time offset between a start of the movement of an actuator-operated gripper system and a start of movement of the edge of the sheet material covering the sensor element.

4. The method according to claim 3, which includes measuring the time offset in degrees of machine angle.

5. The method according to claim 3, which includes determining the time offset of the start of movement by a sensor element constructed as an edge sensor.

6. The method according to claim 3, which includes determining the time offset of the start of movement by a sensor element constructed as a linear CCD.

7. The method according to claim 2, which includes performing the correction of the position of the sheet material based upon the laws of motion of an actuator-operated gripper system provided on the following second sheet-guiding cylinder, whereon the trailing edge of the sheet material is gripped.

8. The method according to claim 3, which includes coming to a conclusion, if a time offset set in the control unit is exceeded, that the trailing edge of the sheet material has not been gripped by an actuator-operated gripper system.

9. A device for correcting a position of a sheet material when a direction of motion of the sheet material is reversed in a reversing device, comprising a holding device of a sheet-guiding cylinder serving as a storage drum, a sensor element for sensing a leading edge of the sheet material, said sensor element being assigned to said holding device, another holding device for a trailing edge of the sheet material disposed on a sheet-guiding cylinder serving as a reversing drum, and an operatable actuator assigned to said other holding device of said sheet-guiding cylinder serving as the reversing drum for position correction of said other holding device.

10. The correcting device according to claim 9, wherein said operatable actuator is constructed as a linear drive.

11. The correcting device according to claim 9, wherein said operatable actuator is constructed as a piezoelectric actuator.

12. The correcting device according to claim 9, wherein said operatable actuator is constructed as a magnetic bearing.

13. The correcting device according to claim 9, wherein said sensor element and said other holding device of said sheet-guiding cylinder serving as a reversing drum are connected to one another via a control unit with data and control lines, and said control unit has a control device and a characteristic-curve family wherein parameters relating to the sheet material to be processed are stored.

14. A reversing or turning device for sheet material in sheet-processing machines, in combination with a device for correcting a position of sheet material when a direction of motion thereof is reversed, comprising a holding device of a sheet-guiding cylinder serving as a storage drum, a sensor element for sensing a leading edge of the sheet material, said sensor element being assigned to said holding device, another holding device for a trailing edge of the sheet material disposed on a sheet-guiding cylinder serving as a reversing drum, and an operatable actuator assigned to said other holding device of said sheet-guiding cylinder serving as the reversing or turning drum for position correction of said other holding device.

15. A printing unit having a device for correcting a position of sheet material in a reversing or turning device, comprising a holding device of a sheet-guiding cylinder serving as a storage drum, a sensor element for sensing a leading edge of the sheet material, said sensor element being assigned to said holding device, another holding device for a trailing edge of the sheet material disposed on a sheet-guiding cylinder serving as a turning or reversing drum, and an operatable actuator assigned to said other holding device of said sheet-guiding cylinder serving as the reversing or turning drum for position correction of said other holding device.

16. A multicolor printing machine for processing sheet material, in combination with a device for correcting a position of a sheet material in a reversing or turning device, comprising a holding device of a sheet-guiding cylinder serving as a storage drum, a sensor element for sensing a leading edge of the sheet material, said sensor element being assigned to said holding device, another holding device for a trailing edge of the sheet material disposed on a sheet-guiding cylinder serving as a turning or reversing drum, and an operatable actuator assigned to said other holding device of said sheet-guiding cylinder serving as the turning or reversing drum for position correction of said other holding device.

* * * * *